US009238293B2

(12) United States Patent
Chen et al.

(10) Patent No.: US 9,238,293 B2
(45) Date of Patent: Jan. 19, 2016

(54) POLISHING PAD EDGE EXTENSION

(75) Inventors: Chih Hung Chen, Sunnyvale, CA (US); Shou-Sung Chang, Mountain View, CA (US); Stan D. Tsai, Fremont, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 2195 days.

(21) Appl. No.: 12/253,034

(22) Filed: Oct. 16, 2008

(65) Prior Publication Data

US 2010/0099339 A1 Apr. 22, 2010

(51) Int. Cl.
*B24B 37/20* (2012.01)
*B24B 37/34* (2012.01)

(52) U.S. Cl.
CPC ..... *B24B 37/20* (2013.01); *B24B 37/34* (2013.01)

(58) Field of Classification Search
CPC ..... B24B 37/12; B24B 37/20; B24B 37/30; B24B 37/34; B24B 37/345
USPC ..... 451/41, 54, 285, 287
See application file for complete search history.

(56) References Cited

U.S. PATENT DOCUMENTS

| | | | | |
|---|---|---|---|---|
| 6,361,420 | B1 | 3/2002 | Zuniga et al. | |
| 6,379,230 | B1 | 4/2002 | Hayashi et al. | |
| 6,399,501 | B2 * | 6/2002 | Birang et al. | 438/692 |
| 6,428,386 | B1 * | 8/2002 | Bartlett | 451/6 |
| 6,432,823 | B1 | 8/2002 | Huynh et al. | |
| 7,134,944 | B2 * | 11/2006 | Taylor | 451/56 |
| 7,182,669 | B2 * | 2/2007 | Elledge | 451/6 |
| 7,210,984 | B2 * | 5/2007 | Taylor | 451/44 |
| 7,967,660 | B2 * | 6/2011 | Fukuda et al. | 451/5 |
| 7,967,661 | B2 * | 6/2011 | Taylor et al. | 451/6 |
| 7,976,358 | B2 * | 7/2011 | Fukuda et al. | 451/5 |
| 8,002,607 | B2 * | 8/2011 | Fukuda et al. | 451/5 |
| 2003/0092269 | A1 | 5/2003 | Parikh | |
| 2005/0090105 | A1 * | 4/2005 | Elledge | 438/689 |
| 2007/0164073 | A1 * | 7/2007 | Watanabe et al. | 225/96.5 |
| 2007/0238399 | A1 | 10/2007 | Tolles et al. | |
| 2007/0275637 | A1 * | 11/2007 | Elledge | 451/8 |
| 2008/0057836 | A1 | 3/2008 | Polyak et al. | |
| 2009/0036036 | A1 | 2/2009 | Nangoy et al. | |
| 2009/0239446 | A1 * | 9/2009 | Fukuda et al. | 451/5 |
| 2009/0318061 | A1 * | 12/2009 | Taylor et al. | 451/6 |

FOREIGN PATENT DOCUMENTS

| | | |
|---|---|---|
| KR | 1020050114529 | 12/2005 |
| KR | 1020060030257 | 4/2006 |

OTHER PUBLICATIONS

International Search Report and Written Opinion of the International Searching Authority mailed Mar. 26, 2010 in PCT/US2009/054527.

* cited by examiner

*Primary Examiner* — Eileen Morgan
(74) *Attorney, Agent, or Firm* — Patterson & Sheridan, LLP

(57) ABSTRACT

A method and apparatus for providing a substantially uniform pressure to a polishing surface from a conditioning element is provided. The method includes urging a conditioning disk against a polishing surface of a rotating polishing pad, moving the conditioning disk across the polishing surface in a sweep pattern that includes at least a portion of the conditioning disk extending over a peripheral edge of the polishing surface, and maintaining a substantially uniform pressure to the polishing surface from the conditioning disk across the sweep pattern.

15 Claims, 4 Drawing Sheets

POLISHING PAD EDGE EXTENSION

BACKGROUND OF THE INVENTION

1. Field of the Invention

Embodiments of the present invention generally relate to polishing a substrate, such as a semiconductor wafer.

2. Description of the Related Art

In the fabrication of integrated circuits and other electronic devices on substrates, multiple layers of conductive, semiconductive, and dielectric materials are deposited on or removed from a feature side, i.e., a deposit receiving surface, of a substrate. As layers of materials are sequentially deposited and removed, the feature side of the substrate may become non-planar and require planarization and/or polishing. Planarization and polishing are procedures where previously deposited material is removed from the feature side of the substrate to form a generally even, planar or level surface. The procedures are useful in removing undesired surface topography and surface defects, such as rough surfaces, agglomerated materials, crystal lattice damage, and scratches. The procedures are also useful in forming features on a substrate by removing excess deposited material used to fill the features and to provide an even or level surface for subsequent deposition and processing.

Chemical mechanical polishing is one process commonly used in the manufacture of high-density integrated circuits to planarize or polish a layer of material deposited on a semiconductor wafer by moving the feature side of the substrate in contact with a polishing pad while in the presence of a polishing fluid. Material is removed from the feature side of the substrate that is in contact with the polishing surface through a combination of chemical and mechanical activity.

Periodic conditioning of the polishing surface is required to maintain a consistent roughness and/or a generally flat profile across the polishing surface. The conditioning is typically performed using a rotating conditioning disk that is swept across and urged against the polishing surface. Conditioning of the peripheral or edge region of the pad creates challenges to global roughness and/or global flatness of the polishing surface.

Therefore, there is a need for a method and apparatus that facilitates equalized conditioning of the polishing surface.

SUMMARY OF THE INVENTION

A method and apparatus for providing a substantially uniform pressure to a polishing surface from a conditioning element is provided. In one embodiment, an apparatus for extending a peripheral edge of a polishing pad is described. The apparatus includes a base having a platen coupled to an upper surface thereof, a polishing pad coupled to an upper surface of the platen, the polishing pad having a polishing surface, a support member coupled to the base adjacent a peripheral edge of the polishing pad, and a bearing material coupled to an upper surface of the support member, the bearing material having an upper surface that is coplanar with the polishing surface of the polishing pad.

In another embodiment, an apparatus for extending a peripheral edge of a polishing pad is described. The apparatus includes a base having a platen rotatably coupled to an upper surface thereof, a polishing pad coupled to an upper surface of the platen, the polishing pad having a polishing surface, a support member coupled to the base adjacent a peripheral edge of the polishing pad, the support member being adjustable relative to the polishing surface of the polishing pad, and a bearing material coupled to an upper surface of the support member.

In another embodiment, a method for conditioning a peripheral edge of a circular polishing pad is described. The method includes urging a conditioning disk against a polishing surface of a rotating polishing pad, moving the conditioning disk across the polishing surface in a sweep pattern that includes at least a portion of the conditioning disk extending over a peripheral edge of the polishing surface, and maintaining a substantially uniform pressure to the polishing surface from the conditioning disk across the sweep pattern.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
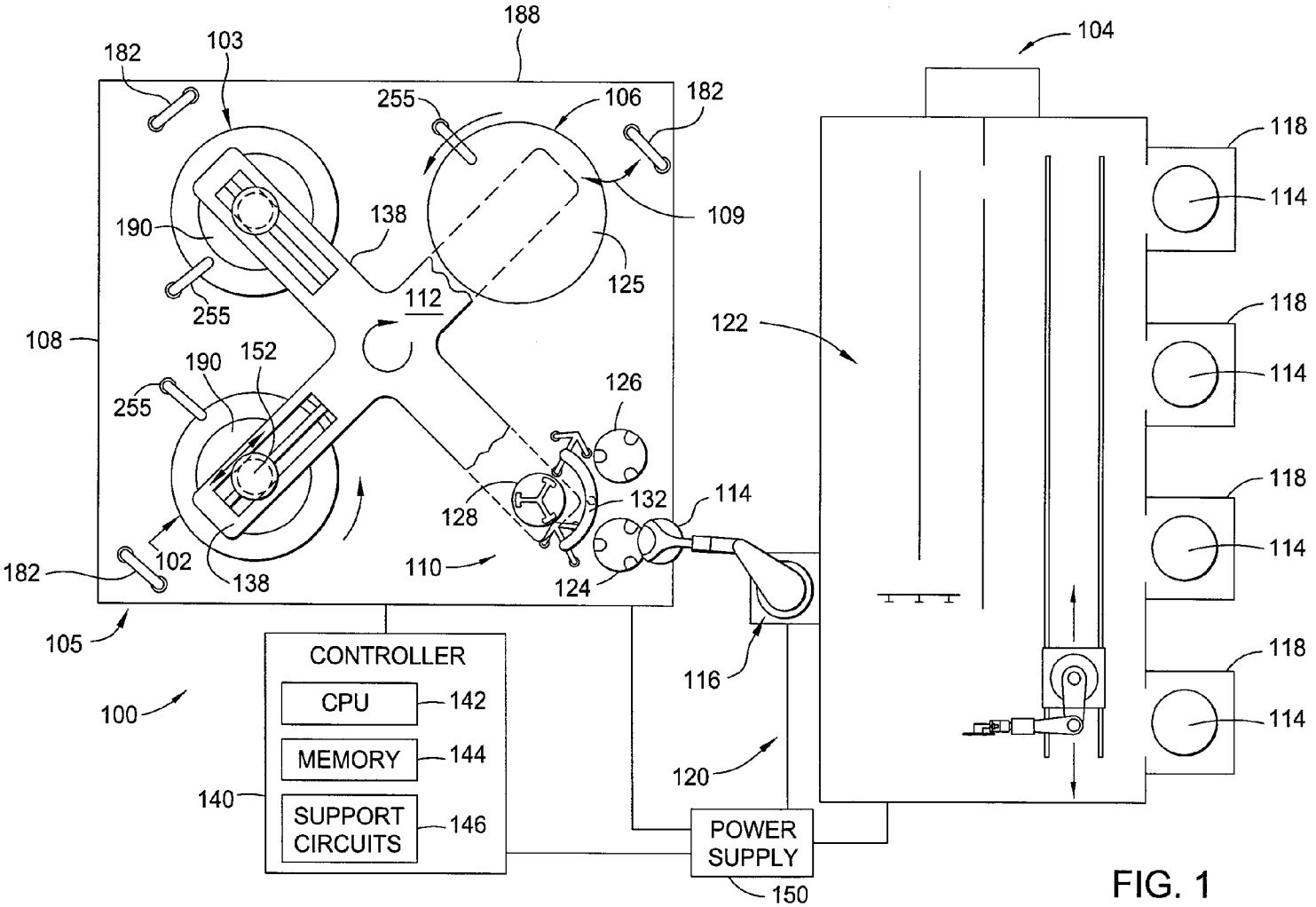
FIG. 1 is a plan view of a processing system.

FIG. 1 is a plan view of a processing system 100 having a processing module 105 that is suitable for electrochemical mechanical polishing and/or chemical mechanical polishing. The processing module 105 includes a first processing station 102, a second processing station 103, and a third processing station 106 disposed in an environmentally controlled enclosure 188. Any of the processing stations 102, 103, 106 may perform a planarizing or polishing process to remove material from a feature side of a substrate to form a planar surface on the feature side. The processing module 105 may be part of a processing system, such as, for example REFLEXION®, REFLEXION® LK, REFLEXION® LK ECMP™, MIRRA MESA® polishing systems available from Applied Materials, Inc., located in Santa Clara, Calif., although other polishing systems may be utilized. Other polishing modules, including those that use other types of processing pads, belts, indexable web-type pads, or a combination thereof, and those that move a substrate relative to a polishing surface in a rotational, linear or other planar motion may also be adapted to benefit from embodiments described herein.

For example, the first processing station 102 may be configured to perform an electrochemical mechanical planarization (ECMP) process, while the second processing station 103 and the third processing station 106 may perform a conventional chemical mechanical polishing (CMP) process. It is to be understood that the invention is not limited to this configuration and that any or all of the stations 102, 103, and 106 may be adapted to use an ECMP process to remove various layers deposited on the substrate. Alternatively, the processing module 105 may include two stations that are adapted to perform an ECMP process while another station may perform a CMP process. In one embodiment of a process, a substrate having feature definitions formed therein and filled with a barrier layer and then a conductive material disposed over the barrier layer may have the conductive material removed. The removal can be in two steps in the first and second processing stations 102, 103, by a CMP process, with the barrier layer processed in the third station 106 by a third CMP process to form a planarized surface on the substrate.

The embodiment described in system 100 includes a base 108 that supports the processing stations 102, 103 and 106, a transfer station 110, and a carousel 112. A plurality of conditioning devices 182 are shown coupled to the base 108 and are movable in the direction indicated by arrow 109 in order to selectively place the conditioning device 182 over each of the processing stations 102, 103, and 106. The transfer station 110 generally facilitates transfer of substrates 114 to and from the system 100 via a loading robot 116. The loading robot 116 typically transfers substrates 114 between the transfer station 110 and an interface 120 that may include a cleaning module 122, a metrology device 104 and one or more substrate storage cassettes 118.

The transfer station 110 comprises an input buffer station 124, an output buffer station 126, a transfer robot 132, and a load cup assembly 128. The loading robot 116 places the substrate 114 onto the input buffer station 124. The transfer robot 132 has two gripper assemblies, each having pneumatic gripper fingers that hold the substrate 114 by the substrate's edge. The transfer robot 132 lifts the substrate 114 from the input buffer station 124 and rotates the gripper and substrate 114 to position the substrate 114 over the load cup assembly 128, and then places the substrate 114 down onto the load cup assembly 128.

The carousel 112 supports a plurality of carrier heads 190, each of which retains one substrate 114 during processing. The carousel 112 moves the carrier heads 190 between the transfer station 110 and processing stations 102, 103 and 106. The carousel 112 is centrally disposed on the base 108 and includes a plurality of arms 138. Each arm 138 supports one of the carrier heads 190. Two of the arms 138 depicted in FIG. 1 are shown in phantom so that the transfer station 110 and a processing surface 125 of the processing station 106 may be seen. The carousel 112 is indexable such that the carrier head 190 may be moved between processing stations 102, 103, 106 and the transfer station 110 in a sequence defined by the user.

The carrier head 190 retains the substrate 114 while the substrate 114 is disposed in the processing stations 102, 103, 106, which allows the substrate 114 to be sequentially processed by moving the substrate between stations while being retained in the same carrier head 190.

To facilitate control of the processing system 100 and processes performed thereon, a controller 140 comprising a central processing unit (CPU) 142, memory 144 and support circuits 146 is connected to the processing system 100. The CPU 142 may be one of any form of computer processor that can be used in an industrial setting for controlling pressures and various drives disposed on the system 100. The memory 144 is connected to the CPU 142. The memory 144, or computer-readable medium, may be one or more of readily available memory such as random access memory (RAM), read only memory (ROM), floppy disk, hard disk, or any other form of digital storage, local or remote. The support circuits 146 are connected to the CPU 142 for supporting the processor in a conventional manner. These circuits include cache, power supplies, clock circuits, input/output circuitry, subsystems, and the like.

Power to operate the processing system 100 and/or the controller 140 is provided by a power supply 150. Illustratively, the power supply 150 is shown connected to multiple components of the processing system 100, including the transfer station 110, the interface 120, the loading robot 116 and the controller 140.

Figure 2:
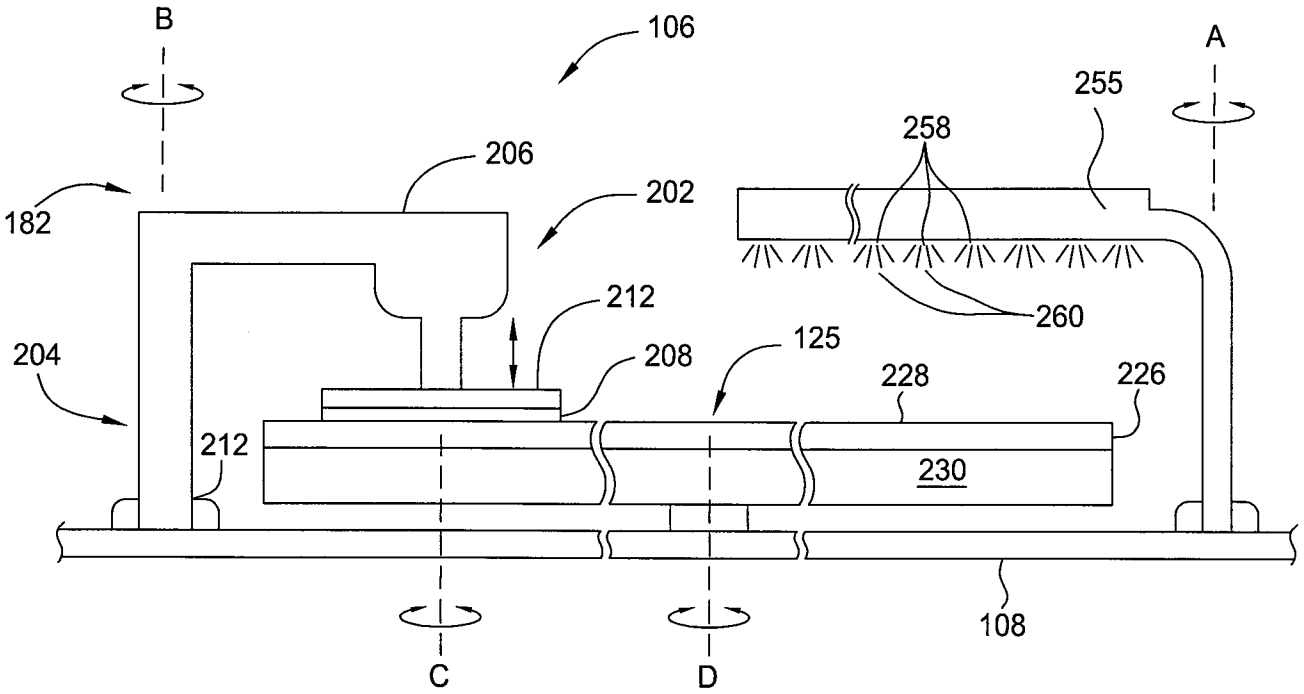
FIG. 2 is a partial sectional view of one embodiment of a processing station.

FIG. 2 is a partial sectional view of one embodiment of a processing station 106 that is configured to perform a conventional CMP process. A conditioning device 182 and a spray bar 255 are shown positioned over the processing surface 125 of a polishing pad 226. The spray bar 255 includes a plurality of nozzles 258 adapted to provide fluids to at least a portion of the radius of the polishing pad 226. The spray bar 255 is rotatably coupled to the base 108 about a centerline A and provides a fluid 260 that is directed toward the processing surface 125. The fluid 260 may be a chemical solution, a cleaning solution, or a combination thereof. For example, the fluid 260 may be an abrasive containing or abrasive free polishing compound adapted to aid in removal of material from the feature side of the substrate. Reductants and oxidizing agents such as hydrogen peroxide may also be added to the fluid 260. Alternatively, the fluid 260 may be a rinsing agent, such as deionized water (DIW), which is used as a rinse or flush to remove polishing byproducts from the polishing material 228. In an alternative, the fluid 260 may be used to facilitate conditioning of the polishing surface 125 to open the microscopic pore structures of the processing surface 125.

The conditioning device 182 generally includes a conditioner carrier 212 coupled to the head assembly 202, which is coupled to a support member 204 by an arm 206. The support member 204 is disposed through the base 108 of the processing station 106. Bearings are provided between the base 108 and the support member 204 to facilitate rotation of the support member 204 about a centerline B relative to the base 108. An actuator (not shown) may be coupled between the base 108 and the support member 204 to control the rotational orientation of the support member 204 about the centerline B and laterally position the head assembly 202 relative to the processing station 106. The support member 204 may house drive components to selectively rotate the conditioning element 208 relative to the polishing pad 226 about a centerline C. The support member 204 may also provide fluid conduits to control the vertical position of one of the conditioner carrier 212 or the head assembly 202.

A conditioning element 208 is coupled to the bottom surface of the conditioner carrier 212. The conditioner carrier 212 is coupled to the head assembly 202 and may be selectively pressed against the platen 230 while rotating about centerline C to condition the polishing material 228. Likewise, the platen 230 with the polishing pad 226 thereon rotates relative to the base 108 about a centerline D. The conditioning element 208 may be urged toward the polishing material 228 at a pressure or downforce between about 0.1 pound-force to about 20 pound-force. The conditioning element 208 may be an abrasive disc, such as a diamond or ceramic material, that is configured to abrade and enhance the polishing material 228. Alternatively, the conditioning element 208 may be a brush-type conditioning disk, such as a disk having nylon bristles. The conditioning element 208 is adapted to be easily replaced to provide a new or different disk as desired by the user.

In one embodiment, the polishing material 228 of the polishing pad 226 is a commercially available pad material, such as polymer based pad materials typically utilized in CMP. The polymer material may be a polyurethane, a polycarbonate, fluoropolymers, PTFE, PTFA, polyphenylene sulfide (PPS), or combinations thereof. The pad material may further comprise open or closed cell foamed polymers, elastomers, felt, impregnated felt, plastics, and like materials compatible with the processing chemistries. In another embodiment, the pad material is a felt material impregnated with a porous coating.

Generally, the polishing pad 226 comprises a processing surface 125 which includes a nap that may include microscopic pore structures. The nap and/or pore structures effect material removal from the feature side of the substrate. Attributes such as polishing compound retention, polishing or removal activity, and material and fluid transportation affect the removal rate. In order to facilitate optimal removal of material from the substrate, the processing surface 125 must be roughened and/or fully and evenly open to provide a relatively high and stable removal rate. The roughened processing surface 125 facilitates removal by enhancing pad surface wetability and dispersing polishing compounds, such as, for example, abrasive particles supplied from the polishing compound.

Figure 3:
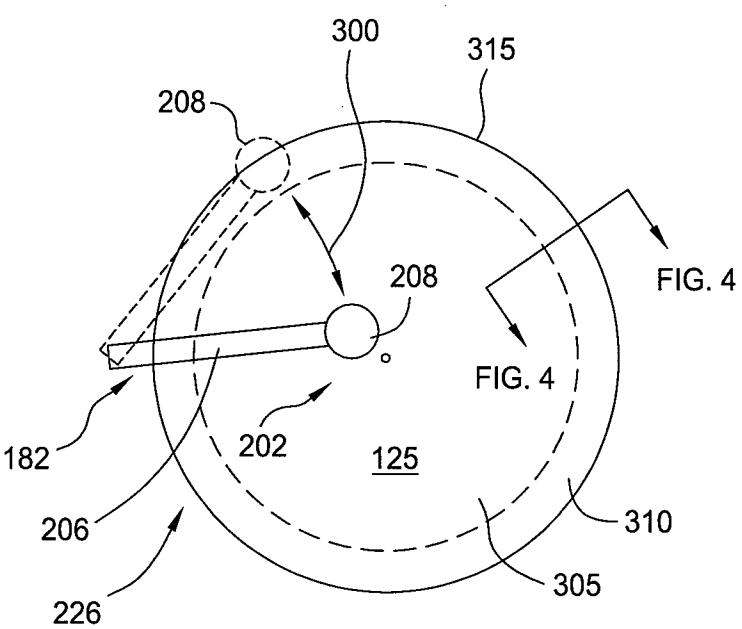
FIG. 3 is a top plan view of a polishing pad showing a conditioning sweep pattern.

FIG. 3 is a top plan view of a polishing pad 226 showing a conditioning sweep pattern 300 on the processing surface 125. The conditioning element 208 is swept across the processing surface 125 to condition and/or refresh the processing surface 125 to facilitate an enhanced removal rate of material from a substrate. The downforce applied to the conditioning element 208 is substantially the same across the sweep pattern 300 which promotes different effects across the processing surface 125.

In FIG. 3, the processing surface 125 is divided into two zones that may experience different conditioning effects from the conditioning element 208. In order to condition the entire processing surface 125 of the polishing pad 226 to provide an increased radial surface area for polishing a substrate and use the processing surface 125 efficiently, the sweep pattern 300 includes moving the center of the conditioning element 208 over an edge 315 of the polishing pad 226. As the center of the conditioning element 208 is moved over the edge 315, part of the conditioning element 208 is not in contact with the processing surface 125, which decreases the surface area of the conditioning element 208 that is in contact with the polishing pad 226. When the downforce applied to the conditioning element 208 is the same, the reduced contact facilitates greater pressure applied to a peripheral zone 310 of the processing surface relative to an inner zone 305. For example, the inner zone 305 experiences a substantially uniform surface pressure from the conditioning element 208 while the peripheral zone 310 experiences a surface pressure from the conditioning element 208 that is different. This non-uniform surface pressure facilitates non-uniform conditioning of the processing surface 125 when the same downforce is applied to the conditioning element 208 across the sweep pattern 300.

Other factors may contribute to the uneven or non-uniform conditioning of the zones 305, 310. For example, as the conditioning element 208 moves over the edge 315, the conditioning element 208 may tilt as it is unsupported over the edge 315. The tilt of the conditioning element 208 may promote greater roughening of the processing surface 125 in the peripheral zone 310.

In one embodiment, the polishing pad 226 is circular and includes a diameter of between about 24 inches to about 52 inches. The inner zone 305 may be defined as a central radial region of the processing surface 125 including a geometric center of the polishing pad 226 up to the peripheral zone 310. The peripheral zone 310 may be defined as the edge region of the processing surface 125. If a circular conditioning element 208 is used, the peripheral zone 310 includes a length that is substantially equal to a radius of the conditioning element 208. For example, if a circular conditioning element 208 having a diameter of about 4.0 inches to about 5.0 inches is used, then the length of the peripheral zone 310 is about 2.0 inches to about 2.5 inches.

Figure 4:
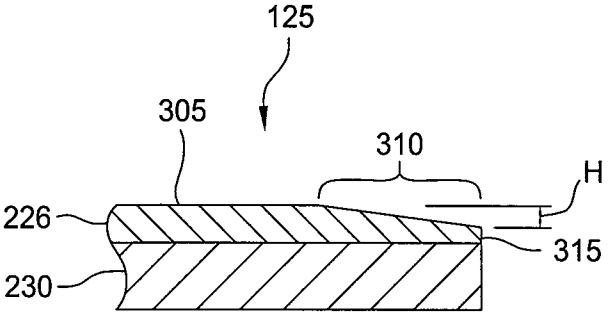
FIG. 4 is a partial cross-sectional view of the polishing pad shown in FIG. 3.

FIG. 4 is a partial cross-sectional view of the polishing pad 226 shown in FIG. 3 showing the result of non-uniform conditioning of the processing surface 125. The non-uniform conditioning may be the product of non-uniform surface pressure from the conditioning element 208 to the processing surface 125 and/or tilt from the conditioning element 208 as the conditioning element 208 reaches the edge 315 of the polishing pad 226. The peripheral zone 310 has been overconditioned by the conditioning element 208 to create a condition sometimes referred to as "edge balding" that is caused by, at least in part, the reduced contact area of the processing surface 125 that is in contact with the conditioning element 208 and/or tilting of the conditioning element 208. The peripheral zone 310 includes a dimension H that indicates a delta in the height of the processing surface 125 of the peripheral zone 310 relative to the inner zone 305. In one embodiment, the dimension H is about 0.005 inches to about 0.010 inches lower than the height of the processing surface 125 in the inner zone 305. The reduced height indicates a greater conditioning force applied to the peripheral zone 310 and destruction of the processing surface 125 at the peripheral zone 310. Thus, the processing surface 125 within the peripheral zone 310 may not be utilized effectively during a polishing process and premature replacement of the polishing pad 226 may result, both of which increase cost of ownership and decreased throughput.

Embodiments described herein provide a method and apparatus to provide uniform pressure to a polishing pad 226 from a conditioning element 208 and therefore counter the effect of non-uniform conditioning across the processing surface 125 of the polishing pad 226. In one embodiment, the downforce of the conditioning element 208 may be varied to include a lower downforce when the conditioning element 208 is at or near the edge 315 of the polishing pad 226. In this embodiment, the conditioning head assembly 202 (FIG. 2) may be coupled to a controller that varies the downforce during the sweep pattern 300 (FIG. 3) to provide a uniform downforce to the entire processing surface 125 of the polishing pad 226. The variation in downforce may be dependent on the surface area of the conditioning element 208 that is overhanging the polishing pad 226. For example, the downforce may be cycled to a lesser downforce as the conditioning element 208 is at or near the edge 315 of the polishing pad 226 and a greater downforce as the conditioning element 208 is within the inner zone 305. In one example, a first downforce may be applied to the conditioning element 208 when it is in the inner zone 305 and a second downforce may be applied to the conditioning element 208 when the conditioning element is at or near the edge 315. In this manner, a uniform conditioning pressure is applied to the polishing pad 226 from the conditioning element 208. The second downforce may be about one fourth (25 percent), about ⅓ (33 percent), or about ½ (50 percent) of the first downforce. In one embodiment, the reduction of downforce is based on the surface area percentage of the conditioning element 208 that is over the edge 315, wherein the downforce is lowered by a factor based on the degree of overhang (the portion of the conditioning element 208 that is over the edge 315. In this manner, a substantially uniform conditioning pressure is applied to the polishing pad 226 from the conditioning element 208.

Figure 5:
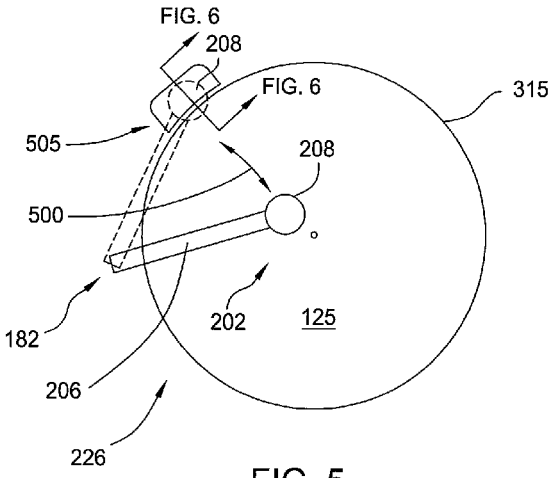
FIG. 5 is a top plan view of a polishing pad showing another conditioning sweep pattern.

FIG. 5 is a top plan view of a polishing pad 226 showing another conditioning sweep pattern 500 on the processing surface 125 of a polishing pad 226. In this embodiment, a polishing pad extension 505 is positioned adjacent the edge 315 of the polishing pad 226. In one embodiment, the polishing pad extension 505 is provided as a support member for the conditioning element 208 allowing the center of the conditioning element 208 to sweep to or beyond the edge 315 of the polishing pad 226.

Figure 6:
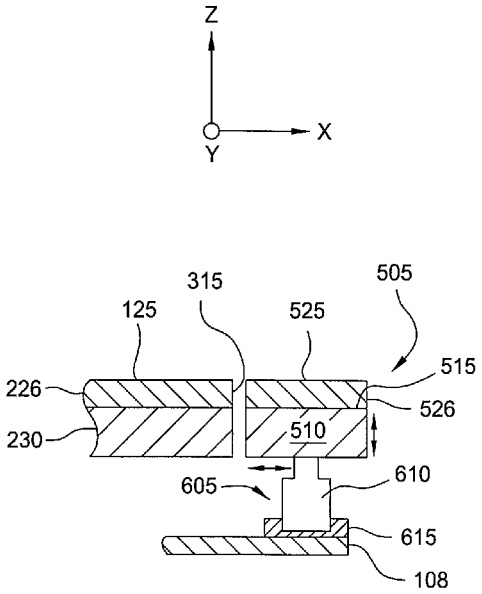
FIG. 6 is a cross-sectional view of a portion of the polishing pad and the polishing pad extension shown in FIG. 5.

FIG. 6 is a cross-sectional view of a portion of the polishing pad 226 and the polishing pad extension 505. The polishing pad extension 505 is disposed on a support member 510 that is movable relative to the edge 315 of the polishing pad 226. An edge extension 526 having a processing surface 525 is supported on an upper surface 515 of the support member 510. In one embodiment, the edge extension 526 may be a small piece of the polishing material 228 as described above. In another embodiment, the edge extension 526 may be a commercially available pad material having a hardness that is greater than the polishing material 228 as described above. In another embodiment, the edge extension 526 may be a sacrificial material or a bearing surface that may be non-consumable or semi-consumable. The edge extension 526 is adhered or otherwise removably coupled to the upper surface 515 of the support member 510 in a manner that allows replacement of the edge extension 526.

One or both of the polishing pad extension 505 and the support member 510 is selectively fixed or adjustable relative to the polishing pad 226. In one embodiment, the support member 510 and the polishing pad extension 505 may be adjusted vertically (Z direction) and horizontally (X and/or Y direction) relative to the horizontal plane of the processing surface and/or the edge 315 and then fixed relative to the polishing pad 226. In one embodiment, the support member is coupled to the base 108 of the processing station. In one aspect, the polishing pad extension 505 includes or is coupled to a drive system 605 adapted to adjust the position of the edge extension 526 at least in the X direction and Z direction. A small gap between the peripheral edge 315 of the polishing pad 226 may be provided to allow for rotational movement of the polishing pad 226 without interference from the polishing pad extension 505.

In one embodiment, the drive system 605 includes an actuator 610 adapted to move the polishing pad extension 505 laterally (X and/or Y direction) and/or vertically (Z direction) relative to the polishing pad 226 and/or platen 230. In one embodiment, the actuator 610 is a pneumatic motor with a brake adapted to move the polishing pad extension 505 laterally and/or vertically relative to the polishing pad 226 and/or platen 230. The actuator 610 may be coupled to a drive platform 615 that may in turn be coupled to the base 108 by fasteners that may be loosened to adjust the drive platform 615 relative to the base 108, which moves the polishing pad extension 505 relative to the polishing pad 226 and/or platen 230. In another embodiment, lateral adjustment of the polishing pad extension 505 is provided by one or more fasteners, such as set screws or bolts, either concentrically or eccentrically. Additionally or alternatively, the actuator 610 may be a hydraulic cylinder, a lead screw, among other mechanical or electromechanical drives.

When a new polishing pad 226 is installed on the platen 230, the height of the processing surface 525 of the polishing pad extension 505 may be matched with the height of the processing surface 125 of the polishing pad 226. Depending on the wear rate of either of the processing surfaces 525 and 125, the height of the processing surface 525 may be readjusted. The height of the processing surface 525 may be determined by a straight edge or gauge relative to the height of the processing surface 125 of the polishing pad 226. In one embodiment, the height is determined by the lower surface of the conditioning element 208 (not shown in this Figure).

The inventors performed tests using a polishing pad extension 505 using an edge extension 526 made of a material that was identical to the material of the polishing pad 226. It was found that the processing surface 525 of the edge extension 505 wears at the same rate as the processing surface 125 of the polishing pad 226. Thus, the polishing pad extension 505 may be replaced during polishing pad replacement without readjustment during processing.

The embodiments described herein provide a method and apparatus for counteracting conditioning effects that may be detrimental to a polishing pad. The method and apparatus as described herein promotes a longer pad lifetime and facilitates a greater usable area of a polishing pad.

While the foregoing is directed to embodiments of the invention, other and further embodiments of the invention may be devised without departing from the basic scope thereof.

What is claimed is:

1. An apparatus for extending a peripheral edge of a polishing pad, comprising:

a base having a platen coupled to an upper surface thereof;

a polishing pad disposed on an upper surface of the platen, the polishing pad having a polishing surface;

a support member coupled to the base adjacent a peripheral edge of the polishing pad; and a bearing material coupled to an upper surface of the support member, the bearing material having an upper surface that is coplanar with the polishing surface of the polishing pad, wherein the upper surface of the bearing material supports a pad conditioning head when the pad conditioning head is positioned beyond an edge of the polishing pad.

2. The apparatus of claim 1, wherein the platen is circular and rotatable relative to the base.

3. The apparatus of claim 1, wherein the polishing pad and the bearing material comprise a polymeric material.

4. The apparatus of claim 3, wherein the polishing pad and the bearing material comprise the same material.

5. The apparatus of claim 1, wherein the support member is coupled to a drive system to move the support member laterally and/or vertically relative to the peripheral edge of the polishing pad.

6. The apparatus of claim 1, wherein the polishing pad is movable and the bearing material is fixed relative to the polishing surface and is separated from the polishing surface by a gap.

7. The apparatus of claim 1, further comprising:

a carrier head for supporting a substrate in an opposing relationship relative to the polishing surface of the polishing pad.

8. An apparatus for extending a peripheral edge of a polishing pad, comprising:

a base having a platen rotatably coupled to an upper surface thereof;

a polishing pad coupled to an upper surface of the platen, the polishing pad having a polishing surface;

a support member coupled to the base adjacent a peripheral edge of the polishing pad, the support member being adjustable relative to the polishing surface of the polishing pad; and a bearing material coupled to an upper surface of the support member, the bearing material disposed at an elevation configured to support a conditioning head assembly at an elevation coplanar with the polishing surface of the polishing pad.

9. The apparatus of claim 8, wherein the polishing pad is circular.

10. The apparatus of claim 8, wherein the bearing material is a sacrificial material.

11. The apparatus of claim 8, wherein the polishing pad and the bearing material comprise the same material.

12. The apparatus of claim 8, further comprising:

a drive system coupled to the support member to move the support member linearly in an X direction and a Z direction relative to the polishing pad.

13. The apparatus of claim 12, wherein the drive system comprises a pneumatic motor.

14. The apparatus of claim 8, wherein the bearing material is fixed relative to the polishing pad and is separated from the polishing pad by a gap.

15. The apparatus of claim 8, further comprising:

a carrier head for supporting a substrate in an opposing relationship relative to the polishing surface of the polishing pad.

* * * * *